United States Patent [19]

Ferguson

[11] Patent Number: 4,841,880

[45] Date of Patent: Jun. 27, 1989

[54] SKELETON FOUR-WAY PALLET

[76] Inventor: Stewart Ferguson, P.O. Box 376, Pacific Beach, Wash. 98571

[21] Appl. No.: 486,585

[22] Filed: Apr. 19, 1983

[51] Int. Cl.[4] ..... B65D 19/31

[52] U.S. Cl. ..... 108/51.1; 108/52.1; 108/56.1; 294/82.1

[58] Field of Search ..... 108/51.1, 52.1, 56.1, 108/56.3, 57.1; 248/542, 647; 294/82 R, 86 R; 206/597

[56] References Cited

U.S. PATENT DOCUMENTS

| | | | |
|---|---|---|---|
| 2,371,106 | 3/1945 | Lewis et al. | 108/57.1 |
| 2,450,432 | 10/1948 | Lehuman | 108/57.1 |
| 2,614,689 | 10/1952 | Miller | 108/56.3 |
| 2,662,711 | 12/1953 | Lapham | 108/52.1 |
| 3,131,655 | 5/1964 | Sellers et al. | |
| 3,237,786 | 3/1966 | Milliken | 206/597 |
| 3,469,542 | 9/1969 | Ahlenius | 108/56.1 |
| 4,059,057 | 11/1977 | Carnwath | 108/51.1 |
| 4,094,544 | 6/1978 | Spaiue | 294/82 R |
| 4,220,099 | 9/1980 | Marchesano | 108/57.1 |

*Primary Examiner*—Peter R. Brown

*Attorney, Agent, or Firm*—Robert W. Beach; Ward Brown

[57] ABSTRACT

A pallet is constructed of two parallel lower beams on edge and four parallel upper beams on edge crossing the lower beams and connected to the lower beams by notched joints which provide clearance for the fork of a forklift beneath the upper beams at two sides of the pallet, and above the upper edges of the lower beams and below the upper edges of the upper beams at the other two sides of the pallet.

10 Claims, 2 Drawing Sheets

Fig. 1.
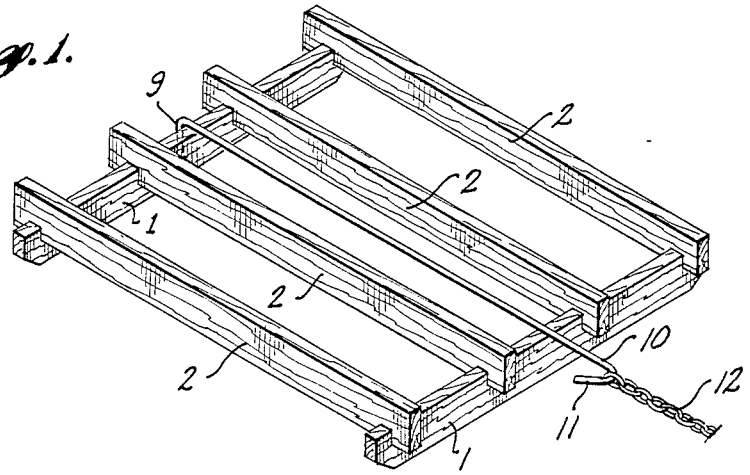
Fig. 2.
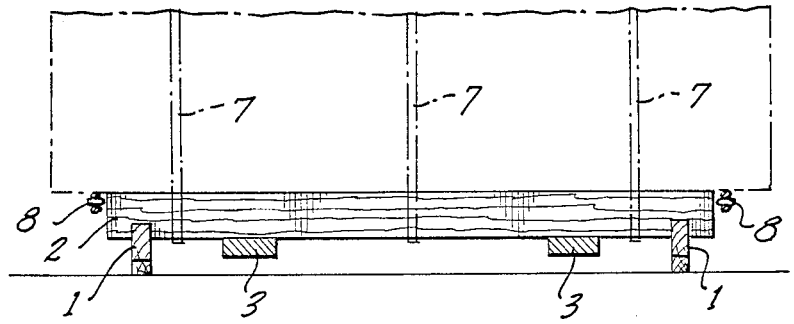
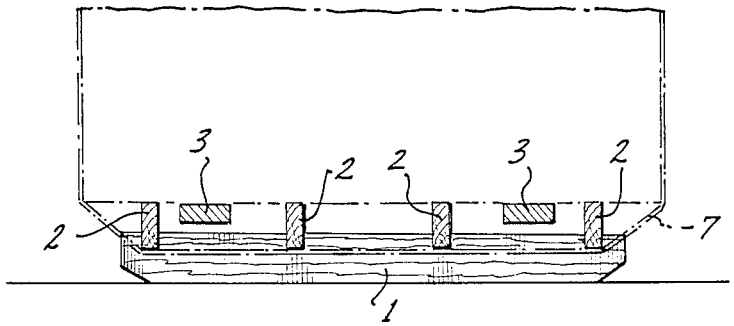
Fig. 3.

Fig. 4.
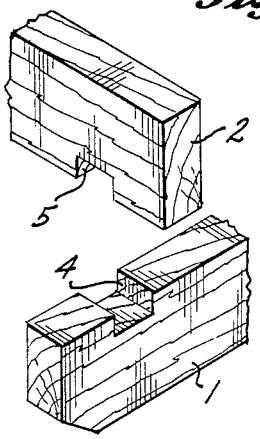
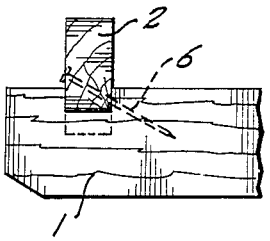
Fig. 5.
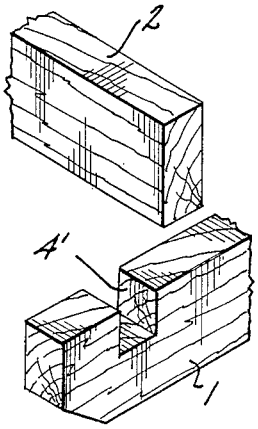
Fig. 6.
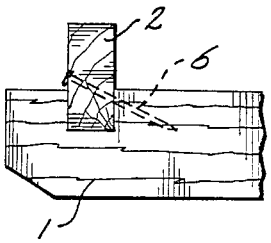
Fig. 7.

SKELETON FOUR-WAY PALLET

BACKGROUND OF THE INVENTION

1. Field of the Invention

This invention relates to a four-way pallet, namely, a square or rectangular pallet all four sides of which are adapted to receive the fork of a forklift, and which pallet is of skeleton construction.

2. Prior Art

The Sellers et al. U.S. Pat. No. 3,131,655, issued May 5, 1964, shows a pallet of substantially skeleton construction, but it is only a two-way pallet.

The skid or shipper pallet shown in FIG. 1 of Carnwath U.S. Pat. No. 4,059,057, issued Nov. 22, 1977, is of skeleton construction and might be used for a pallet, but it is doubtful that the forks of a forklift could enter any side of such a pallet when it is resting on the ground. In any event, it certainly could not be used as a four-way pallet.

SUMMARY OF THE INVENTION

It is a principal object of the present invention to provide a strong, light pallet which can be disposable, and that can be constructed by use of a relatively small amount of material which is used structurally effectively.

It is a further object to make such a pallet of nominally two-inch (5.1 cm) stock, preferably two-by-four (5.1 cm by 10.2 cm) stock, which can be of low grade, that is, having knots and checks in it.

Another object is to provide such a pallet in which structural members of the pallet can function as the load-supporting deck of the pallet.

It is also an object to provide a pallet construction which, while strong, can be capable of twisting to some extent under load so that its base will bear evenly on a warped supporting surface.

The foregoing objects can be accomplished by a pallet of square or rectangular shape formed of two parallel lower base beams of rectangular cross section placed on edge and several parallel upper load-carrying beams of rectangular cross section arranged on edge crossing the base beams and connected by interfitting notches. The base beams and superposed load-carrying beams are arranged to enable the fork of a forklift to enter any of the four sides of the pallet.

BRIEF DESCRIPTION OF THE DRAWINGS

FIG. 1 is a top perspective of a pallet according to the present invention.

FIG. 2 is an elevation of one side of the pallet, and FIG. 3 is an elevation of a side of the pallet taken perpendicular to FIG. 2.

FIG. 4 is a fragmentary top perspective of portions of structural elements of the pallet shown in exploded relationship, and FIG. 5 is a fragmentary side elevation of the portion of the pallet shown in FIG. 4.

FIG. 6 is a fragmentary top perspective of a portion of the pallet corresponding to that shown in FIG. 4, but showing an alternate type of joint with the parts in exploded relationship, and FIG. 7 is a fragmentary side elevation of the portion of the pallet shown in FIG. 6.

DETAILED DESCRIPTION

Conventional pallets such as shown in FIG. 2 of Carnwath U.S. Pat. No. 4,059,057 have been constructed of top or deck boards and bottom boards secured flatwise to the upper and lower edges, respectively, of parallel runners arranged on edge. Usually such boards are face-nailed to the edges of the runners, although in some instances the edges of the runners are mortised to receive the boards so that their outer faces are flush with the edges of the runners or stringers, as shown in FIG. 2 of Sellers et al. U.S. Pat. No. 3,131,655.

An important feature of the present pallet construction is that it is composed of only two layers or courses of parallel beams with the beams in one course crossing the beams of the other course. The structural elements are referred to as beams because they are of rectangular cross section having greater widths than thicknesses, such as being two-by-fours, and such components are arranged on edge so that the greater cross-sectional dimension, such as the four-inch (10.2 cm) width, extends vertically, while the lesser dimension or thickness, such as two inches (5.1 cm), extends horizontally.

As shown in FIG. 1, the lower course or base layer is composed of two parallel two-by-four beams 1 arranged on edge and spaced apart preferably nearly the full width of one horizontal dimension of the pallet, for example, forty-one inches (104 cm) if the total width is forty-eight inches (122 cm). Mounted on the base beams 1 are parallel upper load-supporting beams 2 crossing the base beams forming the upper course. Such upper course beams also are made of two-inch (5.1 cm) lumber, such as two-by fours, disposed on edge with their widths vertical and their thicknesses horizontal. Several of such upper course load-supporting beams are used, four being an appropriate number as shown in FIGS. 1 and 3. The opposite end portions of such upper course beams overhang the lower course beams, respectively, to shorten the span between the lower beams while providing sufficient lateral clearance to receive the fork 3 of a forklift between the lower beams 1.

The joints between the crossing edges of the upper and lower beams are of the interfitted notched type, the preferred construction of the joint having mutual notches, as shown in FIG. 4. The upper edge of the base beam 1 has in it an upwardly opening square notch 4 of a width to embrace snugly the thickness of the upper beam 2. The lower edge of the upper beam has a downwardly opening square notch 5 of a width to receive snugly the thickness of the lower beam 1. Consequently, the upper beam can be interfitted with the lower beam, as shown in FIG. 5, in which the notch of each beam embraces snugly an edge portion of the other beam fitted in it. The depths of the notches 4 and 5 may be equal, but whether or not they are equal the combined depths will be such that there is sufficient clearance both below the upper beams and above the lower beams to receive the thickness of a forklift fork 3. Thus, if two-by-four beams are used, the actual widths of which are $3\frac{1}{2}$ (8.9 cm) to $3\frac{5}{8}$ inches (9.2 cm), the combined depths of the notches should not be greater than about $1\frac{1}{2}$ inches (3.8 cm) so as to leave approximately 2 inches (5.1 cm) clearance, or about 60% of the width of the lower beams between the lower edges of the upper and lower beams and a corresponding clearance between the upper edges of the lower and upper beams. In other words, the major portion of each upper beam width projects upward above the upper edges of the lower beams and the major portion of each lower beam width projects downward below the lower edges of the upper beams. Each notch 4 and 5 could therefore be approximately $\frac{3}{4}$ inch (1.9 cm) deep.

Alternatively, the notched joint could be constructed by having the notch only in one of the beams, as shown in FIGS. 6 and 7. In this instance, the square notch 4' in the upper edge of the lower beam 1 opens upward to receive the lower edge portion of an upper beam 2. In such case, the full amount of the beam overlap is established by the depth of the notch 4', which may be $1\frac{1}{2}$ inches (3.8 cm). If only one of the beams is notched in the construction of a notched joint, it is preferred that the notch be in the upper edge of the lower beam rather than in the lower edge of the upper beam so that the notch will be in an edge under compression rather than in tension. Such joint construction is stronger because it would deter splitting of the upper beam lower edge portion at the bottom of the notch. When the lower edge portion of the beam 2 is inserted fully into the notch 4', the clearance between the lower edges of the upper beams and the lower edges of the lower beams and between the upper edges of the upper beams and the upper edges of the lower beams would be the same as when the type of joint shown in FIGS. 4 and 5 is used.

An advantage of the type of joint having mutually interfitting notches such as shown in FIGS. 4 and 5 over the type of joint having only a single notch such as shown in FIGS. 6 and 7 is that lengthwise shifting of each upper beam relative to the lower beams is prevented. Where only a single notch is used, as shown in FIGS. 6 and 7, the unnotched upper beam 2 is prevented from shifting lengthwise relative to the notched lower beam 1 only by the nails or other fastening means interconnecting the upper and lower beams.

In order to maintain the beams in assembled relationship, each joint should be nailed or glued or, for added strength, both nailed and glued. An advantage of notched joints is that the location of the joint is more readily established and frictional contact between the crossing beams will tend to hold the joint parts in position during a nailing operation. In order to reduce the risk of splitting the beams, the nailing can consist of a single toenail 6 extending diagonally through the upper beam at each joint, as shown in FIGS. 5 and 7.

It is preferred that the pallet lower course have only two base beams so that precision of notch depth and beam width will be less critical than if it were necessary to construct the pallet with the lower edges of more than two base beams coplanar. Also, with only two base beams the pallet should have sufficient flexibility so that the lower edges of such beams will bear evenly on a supporting surface even if such surface is somewhat warped.

While different numbers of upper beams 2 could be pivoted and their spacing selected to accommodate loads of different types, the four equally spaced beams are suitable for loads of shingle bundles or shake bundles shown in phantom in FIGS. 2 and 3 if the upper beams are forty-eight inches (122 cm) long and the base beams are forty inches (102 cm) long. The load can be integrated with the pallet by straps 7 shown in FIGS. 2 and 3 that encircle the load and pass beneath the upper beams 2. The fork 3 of a forklift inserted between the upper edges of the lower beams and the upper edges of the upper beams, as shown in FIG. 3, can engage the bottom of the load. The straps 7 will lift the pallet with the load. Because the straps pass below the lower edges of the upper beams, as shown in FIG. 3, and the fork of the forklift passes above the upper edges of the lower beams, such fork cannot engage and damage the straps. If the straps 7 are severed after the loaded pallet has reached its destination, the forks 3 of a forklift shown in the position of FIG. 3 can be used to lift the load off the pallet.

The fork can enter either of two opposite sides of the pallet, as shown in FIG. 3, and can also enter either of the other two opposite sides of the pallet beneath the lower edges of the upper beams, as shown in FIG. 2. The pallet construction described is, therefore, a four-way pallet.

Instead of the pallet and load being lifted by a forklift in the manner described in connection with FIGS. 2 and 3, the loaded pallet can simply be skidded for a short distance lengthwise of the lower beams 1 by pulling on a chain 8 encircling the pallet beneath the load as shown in FIG. 2. To facilitate such skidding the opposite ends of the lower beams 1 may be beveled as shown in FIGS. 3 to 6. Utilization of notched joints for the pallet beams provides sufficient strength for the pallet to enable the pallet to be skidded, and the use of mutually notched joints, as shown in FIGS. 4 and 5, will further resist damage to the pallet when it is being skidded transversely of the base beams 1.

Such latter skidding can be accomplished by engaging the trailing face of the trailing lower beam 1 of the pallet by a right-angled hook 9 on one end of a slender pull rod 10 extending through the space between the upper edges of the lower beams and the upper edges of the upper beams as shown in FIG. 1. The other end of the pull rod has an acute-angled hook 11 that may extend downward, sideways or upward and be engaged by a chain 12 by which the pulling force is exerted on the pull rod 10. The pull rod can be engaged with the pallet by inserting it beneath the load with the hook 9 in horizontal position and swinging such hook downward beyond the far beam 1 by turning the pull rod when the pull rod has been inserted to a sufficient distance. In this position the force is exerted by the rod on the lower beam 1 which is farther from the end of pull rod 10 on which the pulling force is exerted. Such force will act on the upper beams 2 in compression which will tend to push the lower beam 1 nearer the end of pull rod 10 on which the pulling force is applied, whereas if the hook 9 were engaged with the nearer lower beam 1 it would tend to pull such beam away from the upper beams 2. The pull rod can be removed from the pallet by turning it until the hook 9 again is horizontal, in which position the pull rod can be withdrawn lengthwise from beneath the load.

I claim:

1. A four-way skeleton wooden pallet having four sides each constructed to receive the horizontally-projecting load-lifting fork of a forklift consisting of only two courses of beams, one course being a lower course having a plurality of wooden parallel lower base beams including spaced side beams disposed so that their lower edges for resting on a supporting surface are in a bottom plane, and the other course being an upper course having several wooden parallel upper load-supporting beams including beams disposed so that their upper edges are in a top plane, said upper load-supporting beams crossing said lower base beams mutually perpendicularly, and interfitted notched joint means connecting the lower edge portions of said upper load-supporting beams and upper edge portions of said lower base beams at their crossing locations, the widths of said lower base beams being greater than their thicknesses, and said lower base beams being arranged on edge with their widths vertical and located by said notched joint means with the major portion of such widths lower than the lower edges of said upper load-supporting beams to provide room for insertion of the load-lifting fork between said spaced side beams, below the entire lower edges of said upper load-supporting beams and above said bottom plane of said spaced side lower base beams lower edges, the widths of said upper load-supporting beams being greater than their thicknesses, and said upper load-supporting beams being arranged on edge with their widths vertical and located by said notched joint means with the major portion of such widths higher than the upper edges of said lower base beams to provide room for insertion of the load-lifting fork above the entire upper edges of said lower base beams and below said top plane of said upper load-supporting beams upper edges.

2. The pallet defined in claim 1, in which the beams are of nominal two-inch thickness with the thickness disposed horizontally and of at least nominal four-inch width with the width disposed vertically.

3. The pallet defined in claim 2, in which the beams are two-by-fours.

4. The pallet defined in claim 1, in which the lower edge portions of the upper beams and the upper edge portions of the lower beams are arranged to provide a clearance of at least approximately two inches between the bottom plane of the spaced side lower base beams lower edges and the entire lower edges of the upper load-supporting beams and a clearance of at least approximately two inches between the entire upper edges of the lower base beams and the top plane of the upper load-supporting beams upper edges.

5. The pallet defined in claim 1, in which the notched joint means are formed by mutually notched lower edge portions of the upper load-supporting beams and upper edge portions of the lower base beams.

6. The pallet defined in claim 5, in which the notches in the lower edge portions of the upper load-supporting beams and the notches in the upper edge portions of the lower base beams are of approximately equal depth.

7. The pallet defined in claim 1, in which a notched joint means is formed by engagement of an unnotched edge element of one beam fitting in a notch in an edge portion of a crossing beam.

8. The pallet defined in claim 1, in which the edge portion of one beam in a notched joint is notched and the adjacent edge portion of the other beam of such joint has an element fitting in such notch.

9. In combination with the pallet defined in claim 1, skidding hook means including a slender pull rod of a length equal to a major portion of the pallet width insertable from one side of the pallet above the upper edge of a lower base beam and below the upper edges of the upper beams and having at one end hook means extending down behind and engageable with the trailing face of a lower base side beam at one side of the pallet and having at its other end means at the opposite side of the pallet on which a pulling force lengthwise of the pull rod can be exerted.

10. The pallet defined in claim 1, in which the lower edge portions of the upper load-supporting beams and the upper edge portions of the lower base beams are arranged to provide a clearance of approximately 60% of the width of the lower base beams between the bottom plane of the lower base beams lower edges and the lower edges of the upper load-supporting beams and a clearance of approximately 60% of the width of the upper load-supporting beams between the upper edges of the lower base beams and the top plane of the upper load-supporting beams upper edges.

* * * * *